US010912337B2

(12) United States Patent
Lin et al.

(10) Patent No.: US 10,912,337 B2
(45) Date of Patent: Feb. 9, 2021

(54) SUPPORTING FRAME FOR VAPORIZATION UNIT OF ELECTRONIC CIGARETTE

(71) Applicant: Guangrong Lin, Guangdong (CN)

(72) Inventors: Guangrong Lin, Guangdong (CN); Xianbin Zheng, Guangdong (CN)

(73) Assignee: Guangrong Lin, Shenzhen (CN)

( * ) Notice: Subject to any disclaimer, the term of this patent is extended or adjusted under 35 U.S.C. 154(b) by 350 days.

(21) Appl. No.: 15/781,698

(22) PCT Filed: Aug. 30, 2016

(86) PCT No.: PCT/CN2016/097434

§ 371 (c)(1),
(2) Date: Jun. 6, 2018

(87) PCT Pub. No.: WO2017/096971

PCT Pub. Date: Jun. 15, 2017

(65) Prior Publication Data

US 2018/0352859 A1 Dec. 13, 2018

(30) Foreign Application Priority Data

Dec. 7, 2015 (CN) ..... 2015 2 1004612 U

(51) Int. Cl.
*A24F 13/00* (2006.01)
*A24F 47/00* (2020.01)
*H05B 3/42* (2006.01)

(52) U.S. Cl.
CPC ..... *A24F 47/008* (2013.01); *H05B 3/42* (2013.01)

(58) Field of Classification Search
CPC ..... A24F 47/00
USPC ..... 131/328–329
See application file for complete search history.

(56) References Cited

U.S. PATENT DOCUMENTS

2002/0023391 A1* 2/2002 Nymark ..... E04B 2/7453 52/36.4
2014/0007863 A1* 1/2014 Chen ..... A61M 11/00 128/200.14
2017/0360092 A1* 12/2017 Althorpe ..... F22B 1/284

FOREIGN PATENT DOCUMENTS

CN 103653260 A 3/2014
CN 203563696 U 4/2014
CN 204682536 U 10/2015

OTHER PUBLICATIONS

International Search Report of PCT Patent Application No. PCT/CN2016/097434 dated Nov. 30, 2016.

* cited by examiner

*Primary Examiner* — Phuong K Dinh

(57) ABSTRACT

A supporting frame comprises a hollow frame body, an circumferential protrusion is radially formed on an outer wall, an inner shoulder which has a central hole is radially formed on an inner wall, the frame body is divided into an upper and a lower cavity portion, a rectangular notch is formed on a wall of the upper cavity portion, slots are symmetrically formed on an inner wall of the upper cavity portion, a step is formed on an upper circumferential edge of the central hole, and a backflow groove is formed between the annular-shaped step and the inner wall of the upper cavity portion, bottoms of the two slots are higher than the annular-shaped step, column parts are respectively formed on two sides of openings of the two slots, extending downwards to the annular-shaped inner shoulder and protruding outwards and towards each other to partially close the openings.

9 Claims, 6 Drawing Sheets

SUPPORTING FRAME FOR VAPORIZATION UNIT OF ELECTRONIC CIGARETTE

FIELD OF THE INVENTION

The present invention relates to the technical field of electronic cigarettes, more particularly to a supporting frame for a vaporization unit of an electronic cigarette.

BACKGROUND OF THE INVENTION

The electronic cigarette usually heats and vaporizes e-cigarette liquid by means of a vaporization unit, thereby producing vapor for the smoker. Hence, concerning the using effect of the electronic cigarette, it is crucial that the vaporization can be carried out well by means of the vaporization unit.

Chinese patent application No. 203563696U discloses a vaporization device of a cotton-free electronic cigarette. As shown in FIG. 1, the vaporization device comprises an outer sleeve 1, a supporting frame 2 arranged inside of the outer sleeve 1, a vaporization unit 3 which is fixed into the supporting frame 2, a filter piece 42 and a liquid percolation piece 41 which are sequentially connected to one end of the supporting frame 2, and a fixing seat 5 connected to the other end of the supporting frame 2. As shown in FIGS. 2-3, the supporting frame 2 comprises a frame body 21 which matches the inner space of the outer sleeve 1, a circumferential protrusion 22 radially protruding from the outer circumference wall of the frame body 21, an annular-shaped inner shoulder 24 which has a central hole 23 and is arranged at a position inside the supporting frame and opposite to the circumferential protrusion, an upper cavity 211 and a lower cavity 212 respectively formed and extended in opposite directions from the annular-shaped inner shoulder 24, a slot 25 which is axially symmetrically arranged at the side wall of the upper cavity 211 and passes through the inner shoulder, an annular-shaped step 26 protruded at a position of central hole of the inner shoulder, a rectangular notch 27 which is axially arranged at a plane part of the annular-shaped step on the wall of the upper cavity perpendicular to the slot and works with the end opening of the liquid reservoir 4 to form a vaporizing passage opening, and a backflow groove 28 formed between the inner shoulder of the annular-shaped step and the inner wall of the upper cavity. A heat insulation sleeve 6 is arranged outside the supporting frame 2, so as to further prevent the heat of the vaporization unit from being transferred to the outer sleeve 1 of the electronic cigarette to burn the outer sleeve 1.

The supporting frame disclosed by the above application has thermal insulation property and effectively supports the filter piece and the liquid percolation piece, such that the liquid leakage, which is caused by excess liquid supply due to the tilting or shifting of the filter piece and the liquid percolation piece during the use, is avoid. However, since the notch of the slot structure of the above supporting frame is totally open, the liquid guiding wick can hardly be vertically fixedly positioned in the slot when introducing the liquid guiding wick of the vaporization unit into the slot, and the liquid guiding wick may also be easily released from the slot during use. In this case, bad transmission of the e-cigarette liquid through the liquid guiding wick may occur due to the reduction of contact area of two ends of the liquid guiding wick and the filter piece, which will result in poor vaporization effect. Furthermore, the middle part of the liquid guiding wick, around which the heating coil is wound, is easy to become loose and hang down to block the central hole of the inner shoulder, which will result in unsmooth airflow. Moreover, the other parts of the liquid guiding wick, around which the heating coil is not wound, is easy to become loose and cross with each other. In this case, the e-cigarette liquid can hardly be transmitted to the heating coil, thereby leading to overheating of the heating coil and resulting in burning or charring of the liquid guiding wick which will produce burning taste and bring bad user experience.

SUMMARY OF THE INVENTION

Technical Problems

In view of the above existing problems, the present invention aims to provide a supporting frame for a vaporization unit of an electronic cigarette, which solves the problem that the liquid guiding wick is easy to release from the slot, and thus avoids poor vaporization of the e-cigarette liquid of the electronic cigarette, and avoids burning or charring of the liquid guiding wick which may produce burning taste during smoking due to overheating of the heating coil.

Technical Solutions

The present invention provides a technical solution as follows. A supporting frame for a vaporization unit of an electronic cigarette comprises a hollow frame body which can be arranged inside the electronic cigarette, an circumferential protrusion is radially formed on an outer wall of the frame body, an annular-shaped inner shoulder which has a central hole is radially formed on an inner wall of the frame body, the frame body is divided into an upper cavity portion and a lower cavity portion by the annular-shaped inner shoulder, a rectangular notch is formed on a wall of the upper cavity portion, upstanding recessed slots are symmetrically formed on an inner wall of the upper cavity portion at two sides of the rectangular notch, a protruding annular-shaped step is formed on an upper circumferential edge of the central hole, and a backflow groove is formed between the annular-shaped step and the inner wall of the upper cavity portion, characterized in that, bottoms of the two slots are higher than the annular-shaped step, column parts are respectively formed on two sides of openings of the two slots, and the column parts extend downwards to the annular-shaped inner shoulder and protrude outwards and protrude towards each other to partially close the openings, respectively.

Preferably, through holes extending downwards from the bottoms of the two slots are provided.

Preferably, through holes extend to the bottom end of the lower cavity portion, and a side opening for one through hole is axially arranged on an inner wall of the lower cavity portion and is communicated with an inner cavity surrounded by the lower cavity portion.

Preferably, the supporting frame for the vaporization unit of the electronic cigarette further comprises a vaporization unit, which comprises a liquid guiding wick bent in a U-shaped manner and a heating coil wound around a bottom part of the U shape of the liquid guiding wick, two legs of the U shape of the liquid guiding wick are respectively vertically disposed in the two slots, the bottom part of the U shape of the liquid guiding wick is disposed at the bottoms of the slots, two ends of the heating coil are respectively connected with a lead which passes through respective through hole and electrically connects to a power source of the electronic cigarette.

Preferably, the liquid guiding wick is made of glass fiber materials or diatomite materials.

Preferably, a cavity surrounded by the upper cavity portion has a U shape in cross section.

Preferably, the upper cavity portion has a greater outer diameter than the lower cavity portion.

Preferably, flexible and separable sheet pieces are formed, extending towards each other respectively from the column parts on two sides of the opening of each slot, so as to close the opening of respective slot, and notches of sheet pieces are respectively formed on the sheet pieces at a position adjacent to the bottoms of the slots.

Preferably, the supporting frame for the vaporization unit of the electronic cigarette is made of heat resisting silica gel materials and is formed integrally.

Preferably, the supporting frame for the vaporization unit of the electronic cigarette is made of ceramic materials and is formed integrally.

Advantages

In the supporting frame for the vaporization unit of the electronic cigarette, the bottoms of the two slots are higher than the annular-shaped step. In this way, when the vaporization unit is transversely disposed at the bottoms of the two slots, the vaporization unit can be positioned at a distance from the annular-shaped step, thereby making sure the air which is taken in during smoking can smoothly flow to the heating coil through the central hole and ensuring a good vaporization. Furthermore, due to the column parts which are respectively formed on two sides of the opening of each of the two slots, extend downwards to the annular-shaped inner shoulder, and protrude outwards and protrude towards each other to partially close the opening, the openings of the slots can be partially closed by the column parts, thereby preventing the liquid guiding wick from getting loose and being easy to release from the slots during the introduction of the liquid guiding wick into the slots. In particular, when the supporting frame for the vaporization unit of the electronic cigarette is made of soft materials such as silica gel, the column parts can also function as reinforcement ribs which support the slots to avoid deformation, whereby the liquid guiding wick is also prevented from being easy to release from the slots. Furthermore, through holes extending downwards from the bottoms of the two slots are provided, through which the leads for fixing two ends of the heating coil can pass. Due to the leads, the heating coil and also the liquid guiding wick around which the heating coil is wound can be tensioned and fixed at the bottoms of the two slots. With the above features of the structure, the e-cigarette liquid can be well transmitted by the liquid guiding wick, and during smoking the air can smoothly flow to the heating coil, thereby ensuring a good vaporization of the e-cigarette liquid of the electronic cigarette.

Figure 1:
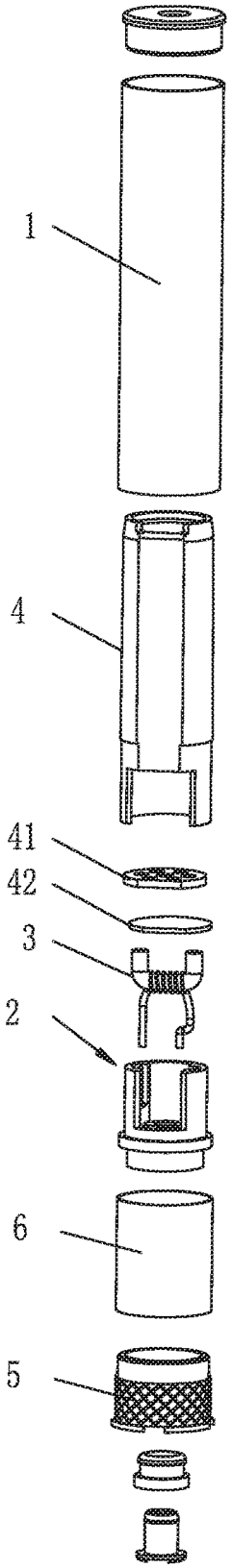
FIG.1(Prior Art)
FIG. 1 is an exploded view of the vaporization device of the cotton-free electronic cigarette in prior art.
Figure 2:
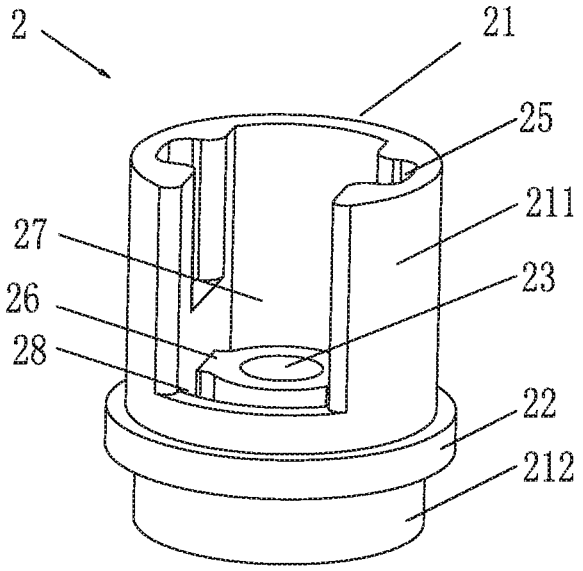
FIG.2(Prior Art)
FIG. 2 is a schematic drawing of the supporting frame for the vaporization unit of the electronic cigarette in prior art.
Figure 3:
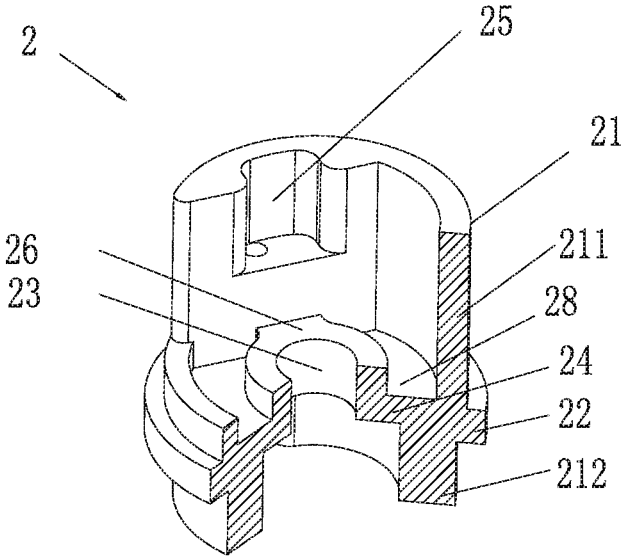
FIG.3(Prior Art)
FIG. 3 is a partial cross-sectional view of the supporting frame for the vaporization unit of the electronic cigarette in prior art.

In the figures, reference numerals of main components are as follows:

outer sleeve 1; supporting frame 2; frame body 21; upper cavity portion 211; lower cavity portion 212; circumferential protrusion 22; central hole 23; annular-shaped inner shoulder 24; slots 25; column parts 251; sheet pieces 252; notches of sheet pieces 253; annular-shaped step 26; rectangular notch 27; annular-shaped groove 28; through holes 29; side opening 291; vaporization unit 3; liquid guiding wick 31; heating coil 32; liquid reservoir 4; liquid percolation piece 41; filter piece 42; fixing seat 5; heat insulation sleeve 6.

DETAILED DESCRIPTION OF ILLUSTRATED EMBODIMENTS

The present invention will be further explained below in detail with reference to figures.

Embodiment 1

A supporting frame 2 for a vaporization unit of an electronic cigarette according to the present invention is shown in FIGS. 4-7. The supporting frame 2 can be disposed in an inner cavity of an outer sleeve 1 of the electronic cigarette and used for supporting a vaporization unit 3 (herein, referring to FIG. 1). The supporting frame 2 comprises a tubular-shaped hollow frame body 21, an annular-shaped circumferential protrusion 22 radially protruding from the outer wall of the frame body 21, and an annular-shaped inner shoulder 24 which radially protrudes from the inner wall of the frame body 21 at a position corresponding to the circumferential protrusion 22 and which has a central hole 23. The frame body 21 is divided into an upper cavity portion 211 and a lower cavity portion 212 by the annular-shaped inner shoulder 24. A rectangular notch 27 having a rectangular shape in cross section is formed on the wall of the upper cavity portion 211. Upstanding recessed slots 25 are symmetrically formed on the inner wall of the upper cavity portion 211 at two sides of the rectangular notch 27. A protruding annular-shaped step 26 is formed on an upper circumferential edge of the central hole 23, and a backflow groove 28 is formed between the annular-shaped step 26 and the inner wall of the upper cavity portion 211. The bottoms of the two slots 25 are symmetrically located in the middle part of the upper cavity portion 211 and are higher than the annular-shaped step 26. Through holes 29 extending downwards from the bottoms of the two slots 25 are provided. Column parts 251 respectively formed on two sides of an opening of each of the two slots 25 and extending downwards to the annular-shaped inner shoulder 24 are provided, which protrude outwards and protrude towards each other to partially close the opening.

Figure 9:
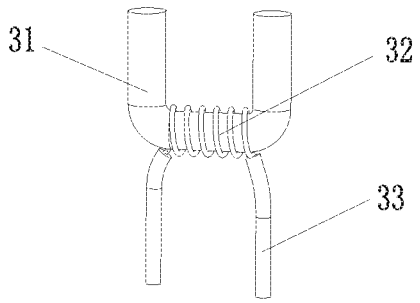
FIG. 9 is a schematic drawing of a vaporization unit according to the present invention.
Figure 10:
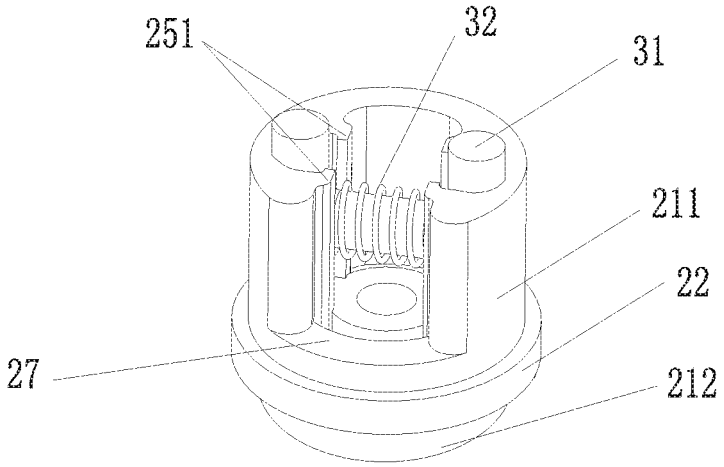
FIG. 10 is a schematic drawing of the supporting frame for the vaporization unit of the electronic cigarette according to Embodiment 1 of the present invention, in which the supporting frame is installed with the vaporization unit.
Figure 11:
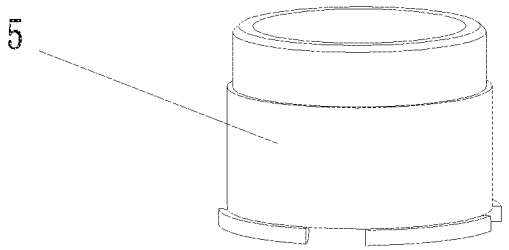
FIG. 11 is a schematic drawing of a fixing seat which mates with the supporting frame according to the present invention.
Figure 12:
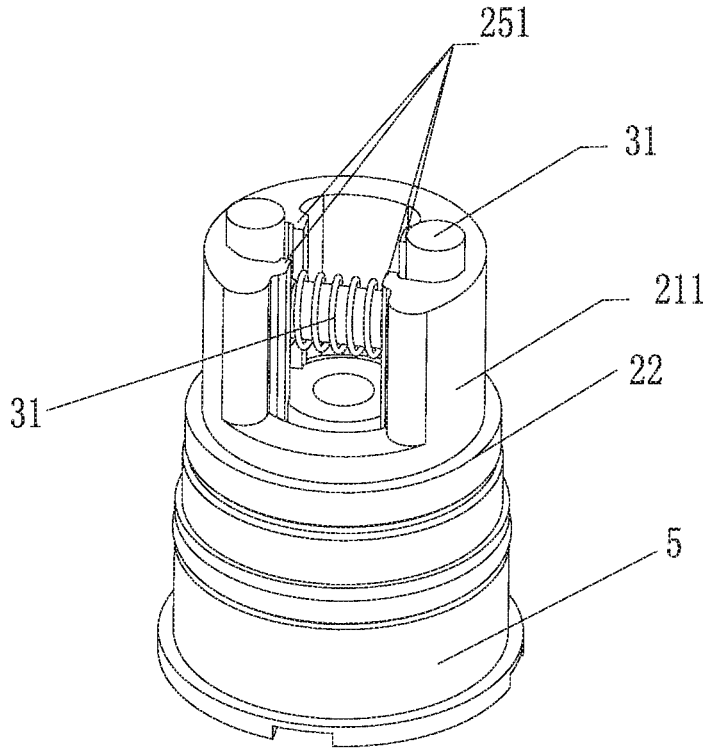
FIG. 12 is a schematic drawing of the supporting frame for the vaporization unit of the electronic cigarette according to Embodiment 1 of the present invention, in which the supporting frame is installed with the fixing seat.

Referring to FIGS. 9-10, the supporting frame 2 for the vaporization unit further comprises a vaporization unit 3 which comprises a liquid guiding wick 31 bent in a U-shaped manner and a heating coil 32 wound around the bottom part of the U shape of the liquid guiding wick 31. Two legs of the U shape of the liquid guiding wick 31 are respectively vertically disposed in the two slots 25. The bottom part of the U shape of the liquid guiding wick 31, around which the heating coil 32 is wound, extends between the bottoms of the slots 25. Two ends of the heating coil 32 are respectively connected with a lead 33 which passes through respective through hole 29 and electrically connects to a power source of the electronic cigarette.

Referring to FIGS. 4-10, in the supporting frame 2 for the vaporization unit of the electronic cigarette according to the embodiment of the present invention, the bottoms of the two slots 25 are symmetrically located in the middle part of the upper cavity portion 211 and are higher than the annular-shaped step 26. In this way, when the vaporization unit 3 is transversely disposed at the bottoms of the two slots 25, the vaporization unit 3 can be positioned at a distance from the annular-shaped step 26 and also the central hole 23, thereby making sure the air which is taken in during smoking can smoothly flow to the heating coil 32 through the central hole 23 and ensuring a good vaporization. Furthermore, due to the column parts 251 which are respectively formed on two sides of the opening of each of the two slots 25, extend downwards to the annular-shaped inner shoulder 24, and protrude outwards and protrude towards each other to partially close the opening, the openings of the slots 25 can be respectively partially closed by the column parts 251, thereby preventing the liquid guiding wick 31 from getting loose and being easy to release from the slots 25 during the introduction of the liquid guiding wick 31. In particular, when the supporting frame 2 for the vaporization unit of the electronic cigarette is made of soft materials such as silica gel, the column parts 251 can also function as reinforcement ribs which support the slots 25 to avoid deformation, whereby the liquid guiding wick 32 is also prevented from being easy to release from the slots 25. Furthermore, through holes 29 extending downwards from the bottoms of the two slots 25 are provided, through which the leads 33 for fixing two ends of the heating coil 32 can pass. Due to the leads 33 which pass through the through holes 29, the heating coil 32 and also the liquid guiding wick 31 around which the heating coil 32 is wound can be tensioned and fixed at the bottoms of the two slots 25. With the above features of the structure, the e-cigarette liquid can be well transmitted to the heating coil 32 by the liquid guiding wick 31, and during smoking the air can smoothly flow to the heating coil 32, thereby ensuring a good vaporization of the e-cigarette liquid of the electronic cigarette.

Referring to FIGS. 5-8, through holes 29 extend to the bottom end of the lower cavity portion 212, a side opening 291 for one through hole 29 is axially arranged on the inner wall of the lower cavity portion 212 so as to allow communication with the circular-shaped inner cavity surrounded by the lower cavity portion 212. Such a configuration is advantageous in that the leads 33 are surely insulated from each other, and the lead 33 disposed in the side opening 291 for the through hole can be guided in the lower cavity portion 212, so as to connect a positive pole of an electrical power source.

Figure 6:
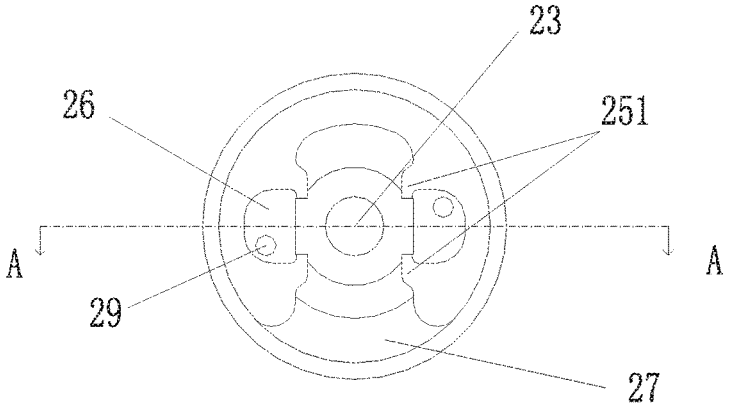
FIG. 6 is a top view of the supporting frame for the vaporization unit of the electronic cigarette according to Embodiment 1 of the present invention.
Figure 7:
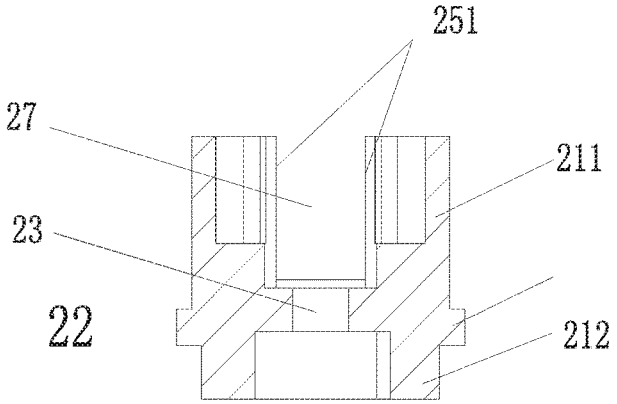
FIG. 7 is a sectional view of the supporting frame for the vaporization unit of the electronic cigarette according to Embodiment 1 of the present invention, taken along a line A-A in FIG. 6.
Figure 8:
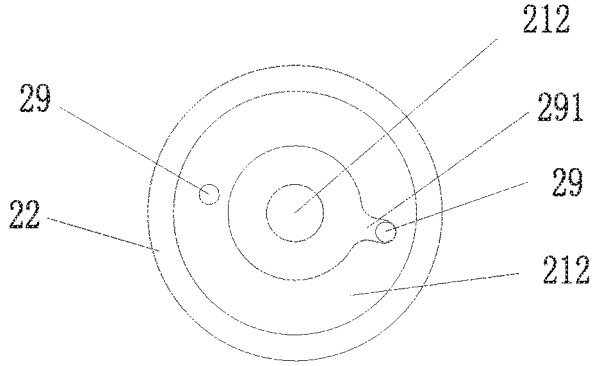
FIG. 8 is a bottom view of the supporting frame for the vaporization unit of the electronic cigarette according to Embodiment 1 of the present invention.

As shown in FIG. 6, in the supporting frame 2 for the vaporization unit of the electronic cigarette according to the embodiment of the present invention, the cavity surrounded by the upper cavity portion 211 has a U shape in cross section. With such configuration, the wall of the upper cavity portion 211 has a sufficient thickness to provide the slots 25, a sufficient space can be provided for the vaporization unit to perform a complete vaporization, and the U-shaped notch, i.e., the rectangular notch, can overlap and coincide with the notch of the liquid reservoir 4 (herein, referring to FIG. 1) to form a part of the vapor passage.

Referring to FIGS. 5 and 10-12, in the supporting frame 2 for the vaporization unit of the electronic cigarette according to the embodiment of the present invention, the upper cavity portion 211 has a greater outer diameter than the lower cavity portion 212. With such configuration, it is convenient to insert the lower cavity portion 212 into the fixing seat 5 and firmly mount it on the fixing seat 5. After mounting, the circumferential protrusion 22 and the upper part of the fixing seat 5 have a same outer diameter such that they can be inserted into the outer sleeve 1 (herein, referring to FIG. 1) at the same time. Furthermore, the upper cavity portion 211 can be put into the opening at one end of the liquid reservoir 4 and bear against the filter piece 42 and the liquid percolation piece 41 (herein, referring to FIG. 1), thereby the liquid guiding wick 31 exposed from the slot 25 can come into contact with the filter piece 42 sufficiently. In this way, the e-cigarette liquid in the liquid reservoir 4 can be transmitted to the liquid guiding wick 31 through the liquid percolation piece 41 and the filter piece 42, and then transmitted to the heating coil 32 inside the supporting frame 2 through the liquid guiding wick 31, thereby during smoking, the e-cigarette liquid can be vaporized to produce vapor when the heating coil 32 is energized.

Figure 4:
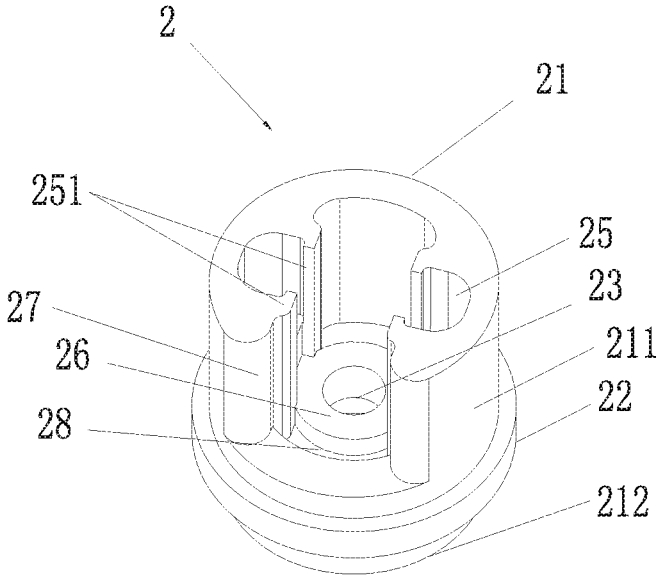
FIG. 4 is a schematic drawing of a supporting frame for a vaporization unit of an electronic cigarette according to Embodiment 1 of the present invention.
Figure 5:
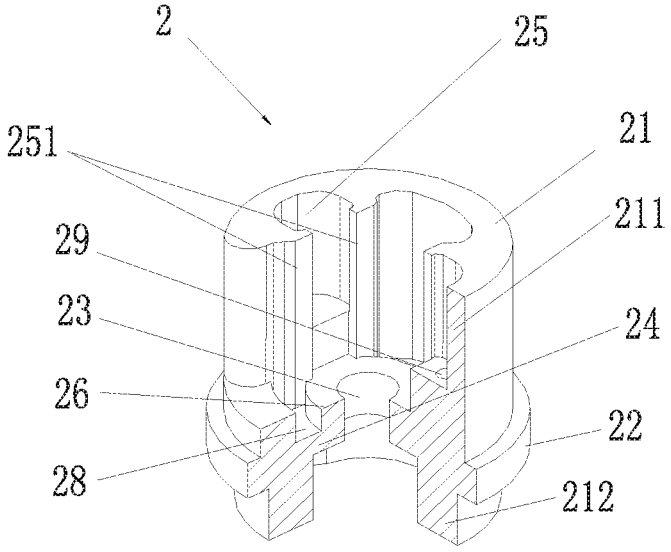
FIG. 5 is a partial cross-sectional view of the supporting frame for the vaporization unit of the electronic cigarette according to Embodiment 1 of the present invention.

Referring to FIGS. 4-5, in the supporting frame 2 for the vaporization unit of the electronic cigarette according to the embodiment of the present invention, the column parts 251 have a flat structure, that is, have a rectangular shape in cross section. It is apparent that the column parts 251 can also be designed to have other shapes such as circular shape, oval shape, square shape and triangle shape in cross section, as long as the liquid guiding wick 31 can be prevented from getting loose and the column parts 251 can function as reinforcement ribs as well.

Referring to FIG. 9, in the supporting frame for the vaporization unit of the electronic cigarette according to the embodiment of the present invention, the liquid guiding wick 31 is made of glass fiber materials. The liquid guiding wick 31 made of glass fiber materials has good performances such as excellent conductivity for the e-cigarette liquid, high temperature resistance, and no harmful substance production even under high temperature. In another embodiment, the liquid guiding wick 31 may be formed by burning diatomite materials, which also provide good performances of excellent conductivity for the e-cigarette liquid and high temperature resistance.

Referring to FIG. 4, the supporting frame 2 for the vaporization unit of the electronic cigarette according to the embodiment of the present invention is made of heat resisting silica gel materials and is formed integrally. The silica gel materials have some flexibility and can facilitate an improvement in sealing. Furthermore, since the ceramic materials have good performances of high temperature resistance and good heat insulation effect, the supporting frame 2 for the vaporization unit of the electronic cigarette according to the embodiment of the present invention may also be made of ceramic materials.

Embodiment 2

Figure 13:
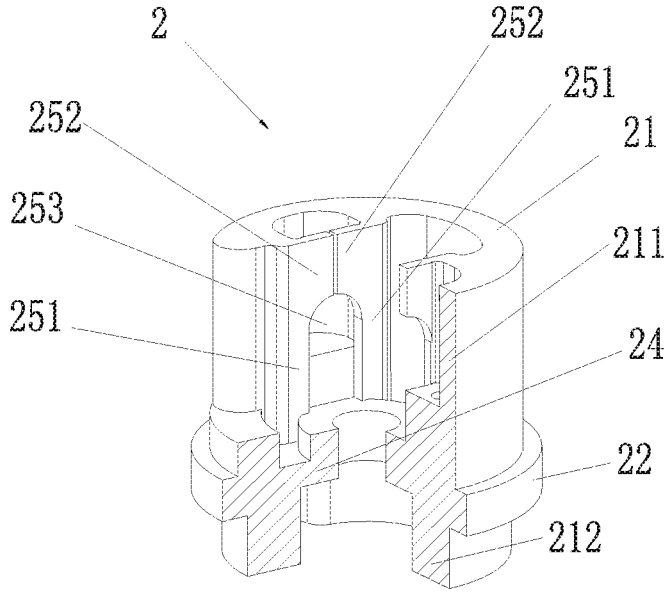
FIG. 13 is a partial cross-sectional view of a supporting frame for a vaporization unit of an electronic cigarette according to embodiment 2 of the present invention.

Referring to FIG. 13, on the basis of Embodiment 1, in order to further prevent the liquid guiding wick 31 from getting loose and being released from the slots 25, flexible and separable sheet pieces 252 are formed, extending towards each other respectively from the column parts 251 on two sides of the opening of each slot 25, so as to close the opening of respective slot. With such configuration, when introducing the liquid guiding wick 31 into the slot 25, two flexible sheet pieces 252 can be separated to allow easy introduction of the liquid guiding wick 31. After the introduction of the liquid guiding wick 31, the two flexible sheet pieces 252 can be automatically closed so as to block the opening of the slot 25 and thus further avoid the releasing of the liquid guiding wick 31. In order to allow the liquid guiding wick to be transversely disposed between the bottoms of the slots 25 and avoid obstructing the transmission of the e-cigarette liquid through the liquid guiding wick 31, notches of sheet pieces 253, through which the liquid guiding wick 31 can pass, are respectively formed on the sheet pieces 252 at a position adjacent to the bottoms of the slots 25.

INDUSTRIAL APPLICABILITY

All the above are merely the preferred embodiments of the present invention, but are not to limit the invention in any form. The present invention is intended to cover all changes, various modifications and equivalent arrangements included within the sprit and scope of the present invention.

The invention claimed is:

1. A supporting frame for a vaporization unit of an electronic cigarette, comprising a hollow frame body which can be arranged inside the electronic cigarette, a circumferential protrusion is radially formed on an outer wall of the frame body, an annular-shaped inner shoulder which has a central hole is radially formed on an inner wall of the frame body, the frame body is divided into an upper cavity portion and a lower cavity portion by the annular-shaped inner shoulder, a rectangular notch is formed on a wall of the upper cavity portion, upstanding recessed slots are symmetrically formed on an inner wall of the upper cavity portion at two sides of the rectangular notch, a protruding annular-shaped step is formed on an upper circumferential edge of the central hole, and a backflow groove is formed between the annular-shaped step and the inner wall of the upper cavity portion, wherein bottoms of the two slots are higher than the annular-shaped step, column parts are respectively formed on two sides of openings of the two slots, and the column parts extend downwards to the annular-shaped inner shoulder and protrude outwards and protrude towards each other to partially close the openings, flexible and separable sheet pieces are formed, extending towards each other respectively from the column parts on two sides of the opening of each slot, so as to close the opening of respective slot, and notches of sheet pieces are respectively formed on the sheet pieces at a position adjacent to the bottoms of the slots.

2. The supporting frame for a vaporization unit of an electronic cigarette according to claim 1, wherein through holes extending downwards from the bottoms of the two slots are provided.

3. The supporting frame for a vaporization unit of an electronic cigarette according to claim 2, wherein the through holes extend to a bottom end of the lower cavity portion, and a side opening for one through hole is axially arranged on an inner wall of the lower cavity portion so as to allow the one through hole to communicate with an inner cavity surrounded by the lower cavity portion.

4. The supporting frame for a vaporization unit of an electronic cigarette according to claim 2, wherein the supporting frame further comprises a vaporization unit, the vaporization unit comprises a liquid guiding wick bent in a U-shaped manner and a heating coil wound around a bottom part of the U shape of the liquid guiding wick, two legs of the U shape of the liquid guiding wick are respectively vertically disposed in the two slots, the bottom part of the U shape of the liquid guiding wick is disposed at bottoms of the slots, two ends of the heating coil are respectively connected with a lead which passes through respective through hole and electrically connects to a power source of the electronic cigarette.

5. The supporting frame for a vaporization unit of an electronic cigarette according to claim 4, wherein the liquid guiding wick is made of glass fiber materials or diatomite materials.

6. The supporting frame for a vaporization unit of an electronic cigarette according to claim 1, wherein a cavity surrounded by the upper cavity portion has a U shape in cross section.

7. The supporting frame for a vaporization unit of an electronic cigarette according to claim 1, wherein the upper cavity portion has a greater outer diameter than the lower cavity portion.

8. The supporting frame for a vaporization unit of an electronic cigarette according to claim 1, wherein the supporting frame is made of heat resisting silica gel materials and is formed integrally.

9. The supporting frame for a vaporization unit of an electronic cigarette according to claim 1, wherein the supporting frame is made of ceramic materials and is formed integrally.

* * * * *